US006824421B2

(12) United States Patent
Oka

(10) Patent No.: US 6,824,421 B2
(45) Date of Patent: Nov. 30, 2004

(54) CONNECTOR HOUSING ASSEMBLY WITH A FIT-ON DETECTION MEMBER

(75) Inventor: Hiroyuki Oka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/633,747

(22) Filed: Aug. 4, 2003

(65) Prior Publication Data

US 2004/0023547 A1 Feb. 5, 2004

(30) Foreign Application Priority Data

Aug. 5, 2002 (JP) ..... 2002-227278

(51) Int. Cl.[7] ..... H01R 13/627
(52) U.S. Cl. ..... 439/489
(58) Field of Search ..... 439/489, 488

(56) References Cited

U.S. PATENT DOCUMENTS 6,234,826 B1 * 5/2001 Wilber et al. ..... 439/489
6,439,915 B2 * 8/2002 Kurimoto ..... 439/489
6,572,400 B2 * 6/2003 Noguchi et al. ..... 439/489
6,575,775 B2 6/2003 Hasegawa et al.

* cited by examiner

*Primary Examiner*—Renee Luebke
(74) *Attorney, Agent, or Firm*—Harness, Dickey & Pierce, P.L.C.

(57) ABSTRACT

While an operation of fitting a male connector housing (10) and a female connector housing (20) on each other is being performed, a connection locking piece (28) is disposed between elastic arms (32). The elastic arms (32) are prevented from elastically deforming inward or in a closing direction. Consequently an interference between a protection wall (29) and an outward projected part (37) is maintained, and the connection locking piece (28) interferes with an inclined surface (36A). The interference securely prevents the pressing operation of a fit-on detection member (30) forward from being performed. When the male connector housing (10) and the female connector housing (20) are normally fit on each other, the connection locking piece (28) is disposed away from the inclined surfaces (32A) and (36A). Thus, there is no interference between the protection wall (29) and the outward projected part (37) and between the connection locking piece (28) and the inclined surface (36A). In this state, an operator can perform the forward pressing operation of the fit-on detection member (30). Thus, the operator can securely detect that the male connector housing (10) and the female connector housing (20) are in the normal fit-on state.

3 Claims, 11 Drawing Sheets

CONNECTOR HOUSING ASSEMBLY WITH A FIT-ON DETECTION MEMBER

CROSS-REFERENCE TO RELATED APPLICATIONS

This application claims priority to Japanese Patent Application No. 2002-227278, filed Aug. 5, 2002, which application is herein expressly incorporated by reference.

FIELD OF THE INVENTION

The present invention relates to connectors and, more particularly, to a connector having a fit-on detection function.

BACKGROUND OF THE INVENTION

Many connectors have a detection device to determine if the connections are secured onto one another. Whether a first or second connector housing is used, fit-n detection is accomplished by utilizing an elastic deforming operation of a locking arm. Thus, whether or not the first or second connector housings have been normally fit on each other is detected according to whether the fit-on detection member can be pressed into a flexing space of the locking arm. More specifically, while an operation of fitting the first connector housing and the second connector housing to each other is being performed, the locking arm is in a deformed state. Therefore, even though the fit-on detection member attempts to be pressed into the flexing space, the fit-on detection member interferes with the locking arm. On the other hand, when the locking arm returns to its original Position due to elastic deformation in consequence of a normal fit-on of the first and second connector housings, the flexing space expands and thus the fit-on detection member can be pressed into the flexing space.

Normally, the connector having the fit-on detection function has an initial position holding mechanism to hold the fit-on detection member at an initial position relative to the connector housing. If a free movement of the fit-on detection member is permitted, an elastic deforming operation of the locking arm is prevented. Further, it is necessary to perform a return operation of the fit-on detection member to its initial position when a detection operation is performed.

It is necessary to release the initial position holding mechanism in consequence of the normal fit on of the first and second connector housings. In Japanese Patent Application laid-Open No. 2001-297827, a construction is disclosed to release the initial position holding mechanism provided on a mating connector housing (first connector housing). A rib is formed inside a hood part of the first connector housing. The initial position holding mechanism is released when the initial position holding mechanism contacts the rib. However, the initial position holding mechanism is formed exclusively for the release of the initial position holding mechanism. Thus the provision of the initial position holding mechanism forces alteration of the ordinary construction of the first connector housing. Thus, the construction, including the initial position holding mechanism does not have general-purpose properties.

SUMMARY OF THE INVENTION

The present invention has been made in view of the above-described problem. Accordingly, it is an object of the present invention to form a fit-on detection element on one of the mating connector housings without altering the construction of the other connector housing.

Accordingly, a connector is provided which includes a pair of connector housings capable of fitting on each other. One of the connector housings includes a locking arm. The locking arm is deformed elastically toward a flexing space by a locking arm contact portion formed on the other connector housing. While a fitting operation of the connector housings on each other is being performed, the locking arm is restored to its original state. When the connector housings are fitted on each other, thus locked to the other connector housing, the connector housings are in a locked state. A fit-on detection member is disposed within a height of the flexing space. The detection member is to be used to detect whether the connector housings are in the normal fit-on state according to whether the fit-on detection member can be pressed into the flexing space.

In this construction, the fit-on detection member includes an elastic arm. The arm is elastically deformed in association with an elastic deforming operation of the locking arm. A receiving portion is formed on the elastic arm and is locked to a locking portion formed on the one connector housing. When the elastic arm is elastically deformed, the fit-on detection member is prevented from being pressed into the flexing space.

When the connector housings are in the normal fit-on state, the elastic arm of the fit-on detection member returns to its original state by elastic deformation. This occurs in association with a restoring operation of the locking arm to its original state. The receiving portion is unlocked from the locking portion and the fit-on detection member can be pressed into the flexing space.

Preferably, the fit-on detection member is approximately U-shaped. The elastic arms are connected to a front portion of the one connector housing in a fit-on direction.

A first guide surface is formed on an opposed surface of each of the elastic arms. The first guide surface inclines in a widthwise direction of the fit-on detection member and slides in contact with the locking arm. Thus, the first guide surface guides the elastic arms, which deform elastically outward in the widthwise direction of the fit-on detection member, when the locking arm is elastically deformed.

A stopping surface is formed on an outer surface of each of the elastic arms. The stopping surface can be locked to a rear end of a protection wall erect at both sides of the locking arm of the one connector housing in a widthwise direction. The stopping surface extends in a front-to-back direction, when the arms elastically deform.

Preferably, the locking arm is cantilevered and extends rearward, with a front end serving as a base. The fit-on detection member is held at a position proximate to the base of the locking arm. Each of the elastic arms has a second guide surface inclined in a front-to-back direction of the fit-on detection member. The guide face is in sliding contact with the locking arm when the locking arm elastically deforms moving the fit-on detection member rearward in combination with the elastic deformation of each of the elastic arms. Preferably, the elastic arms are elastically deformable outward in a widthwise direction of the fit-on detection member.

According to the present invention, the locking arm formed on the one connector housing is elastically deformed toward the flexing space by contact with the locking arm contact portion formed on the other connector housings. This occurs while the fitting operation of the connector housings on each other is being performed.

The elastic arms elastically deform in association with the elastic deformation of the locking arm. The receiving portion formed on the elastic arm is locked to the locking portion formed on one connector housing. This prevents the pressing operation of the fit-on detection member into the flexing space.

When the connector housings are in the normal fit-on state, the fit-on detection member returns to its original state in association with the restoring deforming operation of the locking arm. The receiving portion is unlocked from the locking portion. Thus, the fit-on detection member can be pressed into the flexing space. Accordingly, it is possible to detect whether both housings have been normally fitted on each other according to whether the fit-on detection member can be moved.

According to the connector having the above-described construction, whether both connector housings are in the normal fit-on state can be detected by merely providing the other connector housing with a locking arm contact portion that is an ordinary constituent element of the connector. Thus it is unnecessary to provide the other connector housing with a specific construction to detect whether both connector housings are in the normal fit-on state.

Since the fit-on detection member is disposed within the height of the flexing space, it is unnecessary to form a space to dispose the fit-on detection member. Therefore it is possible to reduce the height of the connector.

A protection wall is formed on a connector having the locking arm. The protection wall prevents the locking arm from being unlocked due to the application of an external force in a normal fit-on state.

According to the present invention, when the elastic arm elastically deforms outwardly because the fitting operation of both connector housings to each other is being performed, the rear end of the protection wall and the stopping surface of the elastic arm can be locked to each other. Therefore, the protection wall, which is an ordinary construction, can be effectively utilized to detect whether or not both connector housings have been fitted normally to each other.

In connector constructions for detecting whether or not both connector housings are normally fitted on each other by a detection member being moved, it is necessary to minimize the length of the movement stroke of the detection member to enable an operator to feel that the operator has performed a detection operation. Consequently the conventional connector is large in one direction by a minimum length of the movement stroke.

According to the present invention, the fit-on detection member is held at a position proximate to the base portion of the locking arm before the fitting operation of both connector housings on each other is performed. In the connector of the present invention, when the locking arm flexes during the operation of fitting both connector housings on each other, the fit-on detection member moves rearward. Thus, the fit-on detection member is compactly accommodated in the flexing space before performance of the fitting operation of both connector housings on each other, but the moving stroke of the fit-on detection member is long while the fitting operation of both connector housings on each other is being performed. Therefore it is possible to prevent the connector from becoming large.

According to the present invention, the elastic arm is capable of elastically deforming outwardly in the widthwise direction of the fit-on detection member, thus contributing to decrease the height of the connector.

BRIEF DESCRIPTION OF THE DRAWINGS

The foregoing and other features of the present invention will become apparent to one skilled in the art to which the present invention relates upon consideration of the invention with reference to the accompanying drawings, wherein.

DETAILED DESCRIPTION OF THE PREFERRED EMBODIMENTS

Figure 1:
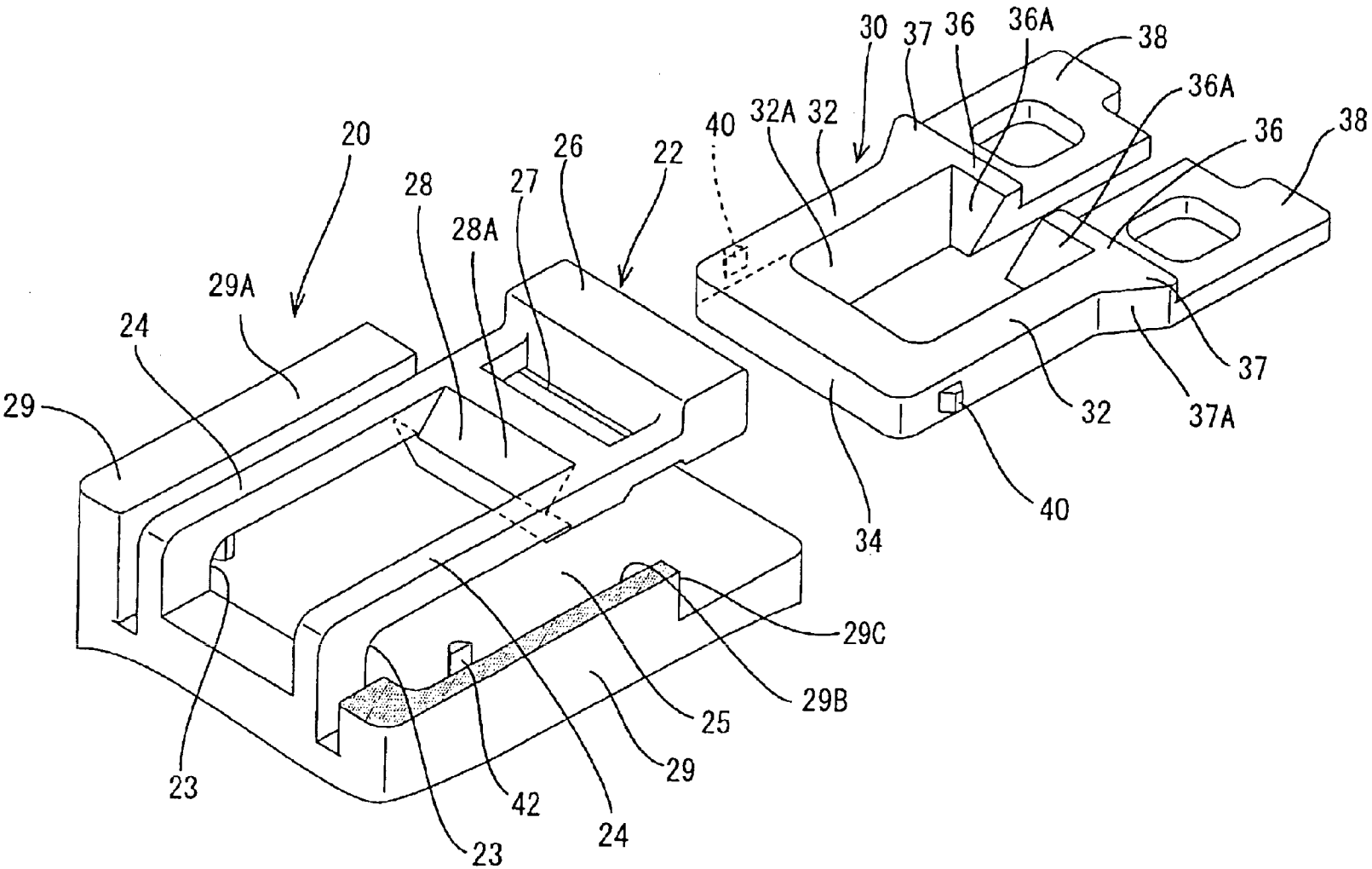
FIG. 1 is an exploded perspective view showing a second connector housing according to an embodiment of the present invention.

An embodiment of the present invention will be described below with reference to FIGS. 1 through 11. The connector of the embodiment includes a first connector housing 10 and a second connector housing 20 capable of fitting on the first connector housing 10. In the description below, the fit-on side of the first connector housing 10 and that of the second connector housing 20 are set as the front.

Initially the first connector housing 10 is described below (see FIG. 3). The first connector housing 10 has a rectangularly cylindrical hood part 11 projecting forward. Unshown tabs of the first terminal fittings project from inside the hood part 11. A locking projection 12, corresponding to locking arm contact portion of the present invention, is disposed at the center, in a widthwise direction, of the first connector housing 10. The locking projection projects inward, inside the hood part 11, from a front edge of the hood part 11. A tapered surface 12A is formed at a lower front end of the locking projection 2. The tapered surface 12A enables the locking projection 12 to easily ride across a connection locking piece 28 of a locking arm 22, which will be described later, to fit the first connector housing 10 and the second connector housing 20 on each other.

A rear surface of the locking projection 12 is formed almost vertically to upper wall of the hood part 11. The rear surface serves as a locking portion 12B to lock the first connector housing 10 and the second connector housing 20 to each other in a normal fit-on state.

The second connector housing 20 will be described below. The second connector housing 20 can be fitted in the hood part 11 of the first connector housing 10. The second connector housing 20 accommodates unshown second terminal fittings. When the second connector housing 20 and the hood part 11 of the first connector housing 10 are in a normal fit-on state, the first and second terminal fittings are fittingly connected to each other.

As shown in FIG. 1, a cantilevered locking arm 22 is formed on the upper surface of the second connector housing 20 at the central part thereof in the widthwise direction of the second connector housing 20. The locking arm 22 is elastically vertically deformable toward a flexing space 25 formed between the upper surface of the second connector housing 20 and the locking arm 22.

The locking arm 22 has two long and narrow arm part 24 erected from front end of the second connector housing 20 and extending rearward parallel with the upper surface of the second connector housing 20. At the rear end of the arm parts 24, the locking arm 22 has a locking arm operation part 26 bridging the two arm part 24. At a predetermined position, forward from the rear end of the arm parts 24, the locking arm 22 has a connection locking piece 28 bridging the two arm parts 24. An upper surface of the connection locking peace 28 is flush with the upper surface of the arm parts 24. A lower surface of the connection locking piece 28 projects downward in a predetermined dimension from the arm parts 24.

Figure 9:
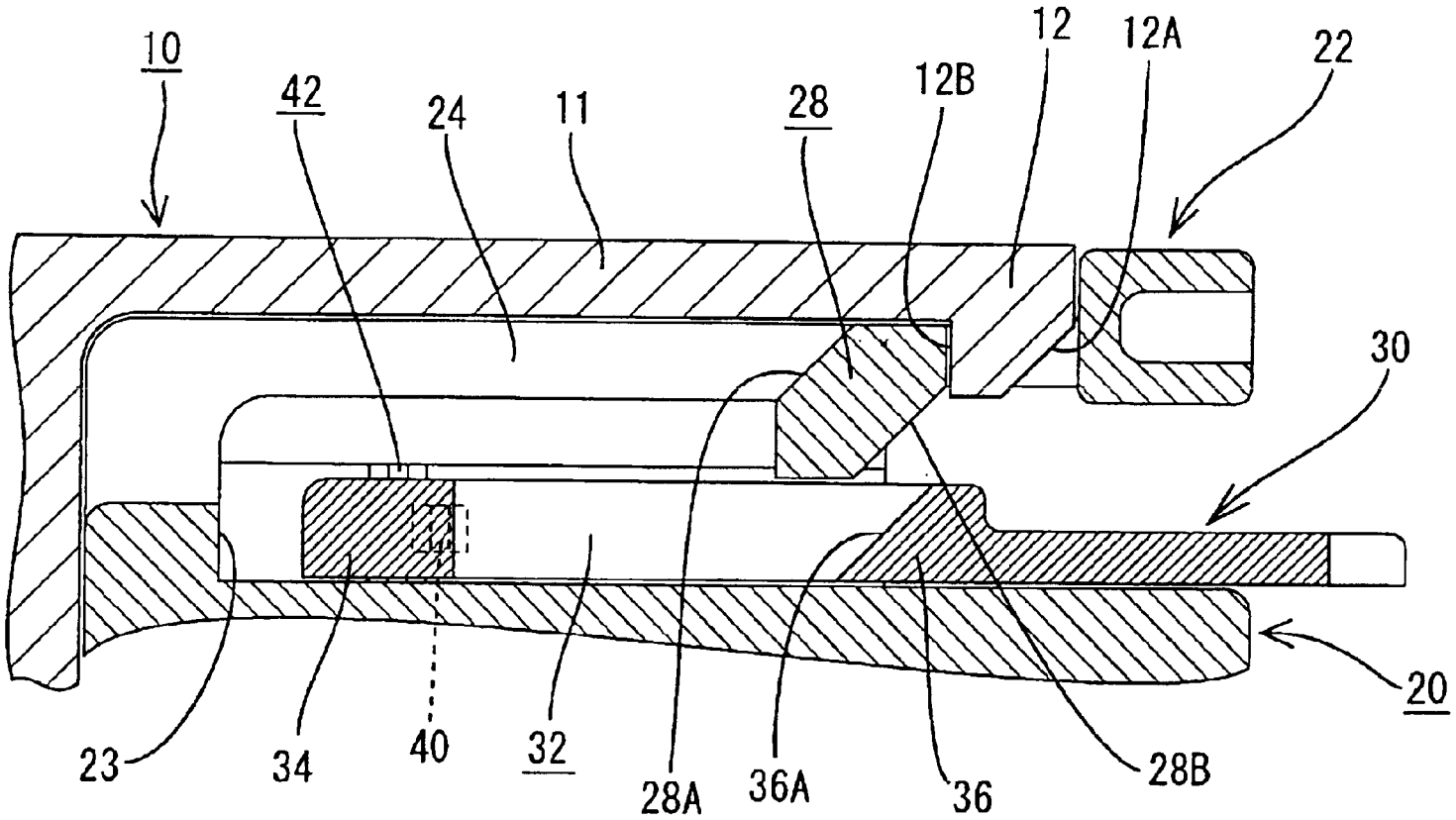
FIG. 9 is a sectional view taken along a line IX—IX of FIG. 8.

A window 27, into which the locking projection 12 can be dropped, is formed between the locking arm operation part 26 and the connection locking piece 28. A tapered surface 28A, across which the locking projection 12 rides in fitting the first connector housing 10 and the second connector housing 20 on each other, is formed on the upper edge of the connection locking piece 28. When the locking projection 12 rides across the tapered surface 28A, and the first connector housing 10 and the second connector housing 20 are normally fit on each other, the locking projection 12 drops into the window 27. The first connector housing 10 and the second connector housing 20 are locked to each other in the normal fit-on state as shown in FIG. 9. To enable a fit-on detection member 30 to elastically smoothly deform outwardly, a tapered surface 28B parallel With the tapered surface 28A is formed in a lower part of a rear surface of the connection locking piece 28. Tapered surfaces 28C and 28D (see FIGS. 4 and 7) are formed in a lower part of both side surfaces of the connection locking piece 28, respectively. The outward elastic deformation of the fit-on detection member 30 is described in detail below.

A protection wall 29 having a predetermined length is erect rearward from a front end of the second connector housing 20 on the upper surface of the second connector housing 20. The protection wall 29 is disposed at both sides of the locking arm 22 in the widthwise direction of the second connector housing 20. The protection wall 29 has a height almost equal to that of the locking arm 22. The protection wall 29 is formed to prevent an external force from being applied to the locking arm 22. Thus, when the first connector housing 10 and the second connector housing 20 are in a normal fit-o state, the first connector housing 10 and the second connector housing 20 are prevented from being unlocked from each other. In this embodiment, a protruded part 29A is formed inward at the upper end of the protection wall 29 to prevent an upward, deviation of the fit-on detection member 30, which will be described later. The inner surface of the protection wall 29 is formed as a slide surface 29B for the fit-on detection member 30 when it is pressed into the flexing space 25.

The fit-on detection member 30 detects whether the first connector housing 10 and the second connector housing 20 are in the normal fit-on state. The fit-on detection member 30 is mounted in a region surrounded by the protection wall 29 and within the height of the flexing space 25 formed between the upper surface of the second connector housing 20 and the locking arm 22. The fit-on detection member 30 is approximately U-shaped. The fit-on detection member 30 includes a pair of elastic arms 32 and a web 34 connecting the elastic arms 32 to each other. The fit-on detection member 30 is capable of elastically deforming outward.

A position of the fit-on detection member 30 mounted on the second connector housing 20 is hereinafter referred to as its initial position. At the initial position, to enable the fit-on detection member 30 to be elastically deformable outward, a predetermined gap is formed between the inner surface of the protection wall 29 and an outer surface of the fit-on detection member 30 disposed forward from an outward projected part 37 of the fit-on detection member 30 which will be described later. The front end of the web 34 is held at a position proximate to a base portion 23 of the locking arm 22 to prevent the fit-on detection member 30 from moving forward. At the initial position, a locking projection 40, formed on the outer surface of each of the elastic arms 32 and in the vicinity of the web 34, engage a rearward movement prevention projection 42 formed on the second connector housing 20. Thus, a rearward movement of the fit-on detection member 30 is prevented.

In this embodiment, the first connector housing 10 and the second connector housing 20 are in a normal fit-on state if it is determined that a forward pressing operation of the fit-on detection member 30 can be performed by moving rearward from the initial position.

More specifically, while an operation of fitting the first connector housing 10 and the second connector housing 20 on each other is being performed, the operation of pressing the fit-on detection member 30 forward cannot be performed. When the first connector housing 10 and the second connector housing 20 have reached the normal fit-on state, the operation of pressing the fit-on detection member 30 forward can be accomplished. In the embodiment, whether the forward pressing operation of the fit-on detection member 30 can be performed depends on whether the elastic arm 32 elastically deforms outward. The mechanism of the elastic outward deformation of the elastic arm 32 is described below.

Figure 4:
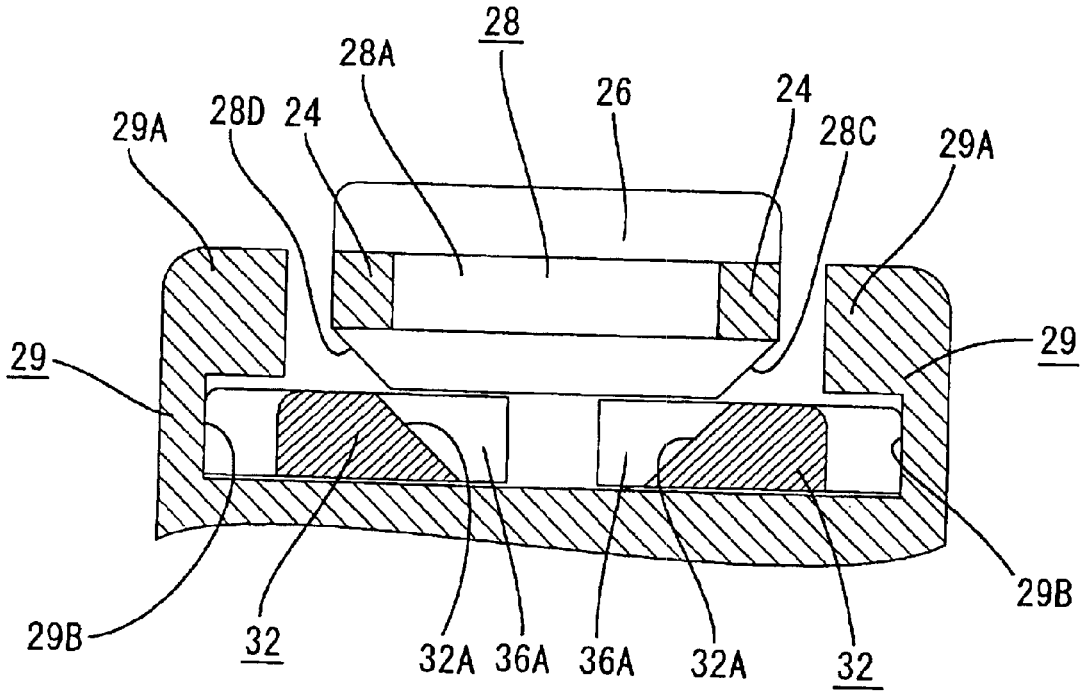
FIG. 4 is a sectional view taken along a line IV—IV of FIG. 2.

An inclined surface 32A corresponding to guide surface of the present invention, is formed on each of the opposed surfaces of the elastic arms 32. When the locking arm 22 elastically deforms downward, the inclined surface 32A is capable of sliding in contact with the connection locking piece 28 of the locking arm 22. As shown in FIG. 4, at the time of the start of the sliding operation of the inclined surface 32A, the distance (width) between the opposed surfaces of the elastic arms 32 becomes a little larger than the width of the lower surface of the connection locking piece 28. At the time of the finish of th sliding operation of the inclined surface 32A, the distance between the opposed surfaces of the elastic arms 32 becomes a little smaller than the width of the lower surface of the connection locking piece 28. Because of this construction, an elastic downward deformation of the locking arm 22 is interlocked with a forced elastic deformation of the elastic arm 32 along the upper surface of the second connector housing 20. Thus, the connection locking piece 28 slides in contact with the inclined surface 32A disposed at the inner side of the elastic arm 32, elastically deforming the elastic arm 32 outward in a horizontal direction (widthwise direction). As will be described below, due to the flexing of the locking arm 22, the fit-on detection member 30 moves rearward as well. During the rearward movement of the fit-on detection member 30, a minimum movable range of the inclined surface 32A in a front-to-back direction is secured to allow the elastic 32 to keep elastically deforming outward. The inclined surface 32A is formed over the entire range of the opposed surfaces of the elastic arms 32.

In the fit-on detection member 30, a pair of opposed inward projected parts 36 is formed at approximately the center of the elastic arm 32 in a direction orthogonal to the extension direction of the elastic arm 32. An inclined surface (corresponding to second guide surface of the present invention) 36A is formed on a front surface of each of the inward projected parts 36. When the locking arm 22 deforms elastically downward, the connection locking piece 28 slides on the inclined surface 36A, and the fit-on detection member 30 moves rearward. The inclination of the inclined surface 36A is set in such a way that the locking projection 40 is capable of securing a stroke at which the locking projection 40 rides across the rearward movement prevention projection 42. Each of the locking projection 40 and the rearward movement prevention projection 42 has a tapered surface for allowing the locking projection 40 to accomplish a smooth ride-across operation.

A pair of outward projected parts 37, corresponding to receiving portion of the present invention, is formed outward from each inward projected part 36. At the initial position, the outward projected part 37 does not contact a rear end 29C, corresponding to locking portion of the present invention, of the protection wall 29. Thus, the fit-on detection member 30 is not locked to the protection wall 29 (see FIG. 2). While the operation of fitting the first connector housing 10 and the second connector housing 20 on each other is being performed, the elastic arm 32 deforms elastically outward. Thus, an outer surface 37A, corresponding to stopping surface of the present invention, disposed in the vicinity of the outward projected part 37 contacts the rear end 29C of the protection wall 29. Accordingly, the fit-on detection member 30 is locked to the protection wall 29.

An approximately rectangular fit-on detection member operation part 38 is disposed rearward from the inward projecting part 36 of each of the elastic arms 32. The fit-on detection member operation part 38 is thinner than the inward projecting part 36 and provides an escape space for the locking arm operation part 26 when the locking arm 22 deforms elastically during fitting operation of the first connector housing 10 and the second connector housing 20 on each other (see FIG. 6). A rear right end of the left-hand fit-on detection member operation part 38 and a rear left end of the right-hand fit-on detection member operation part 38 are stepped respectively.

The operation of the embodiment is described below.

Figure 2:
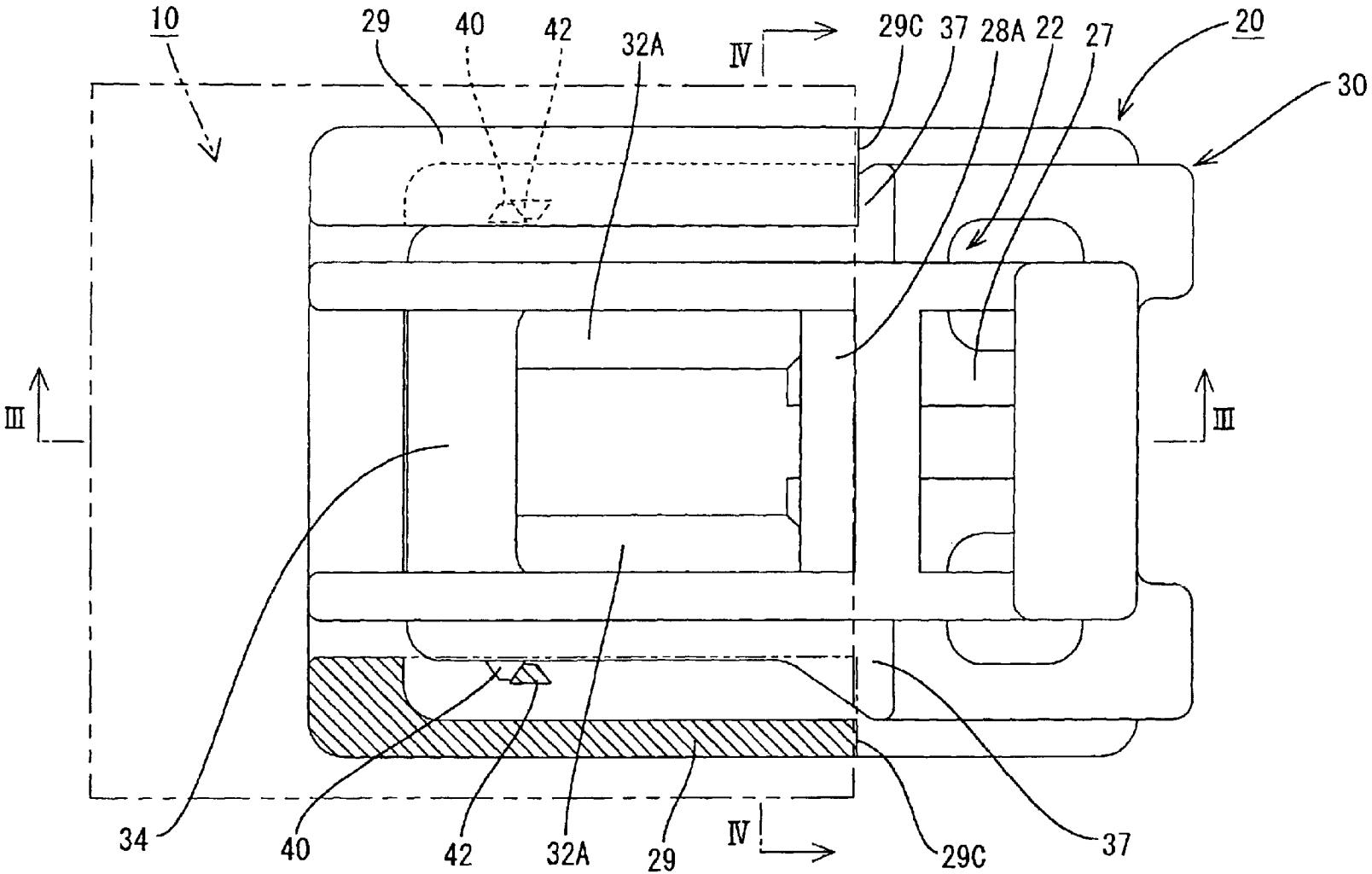
FIG. 2 is a partial cutaway plan view showing an initial state of a fit-on between first and second connector housings.
Figure 3:
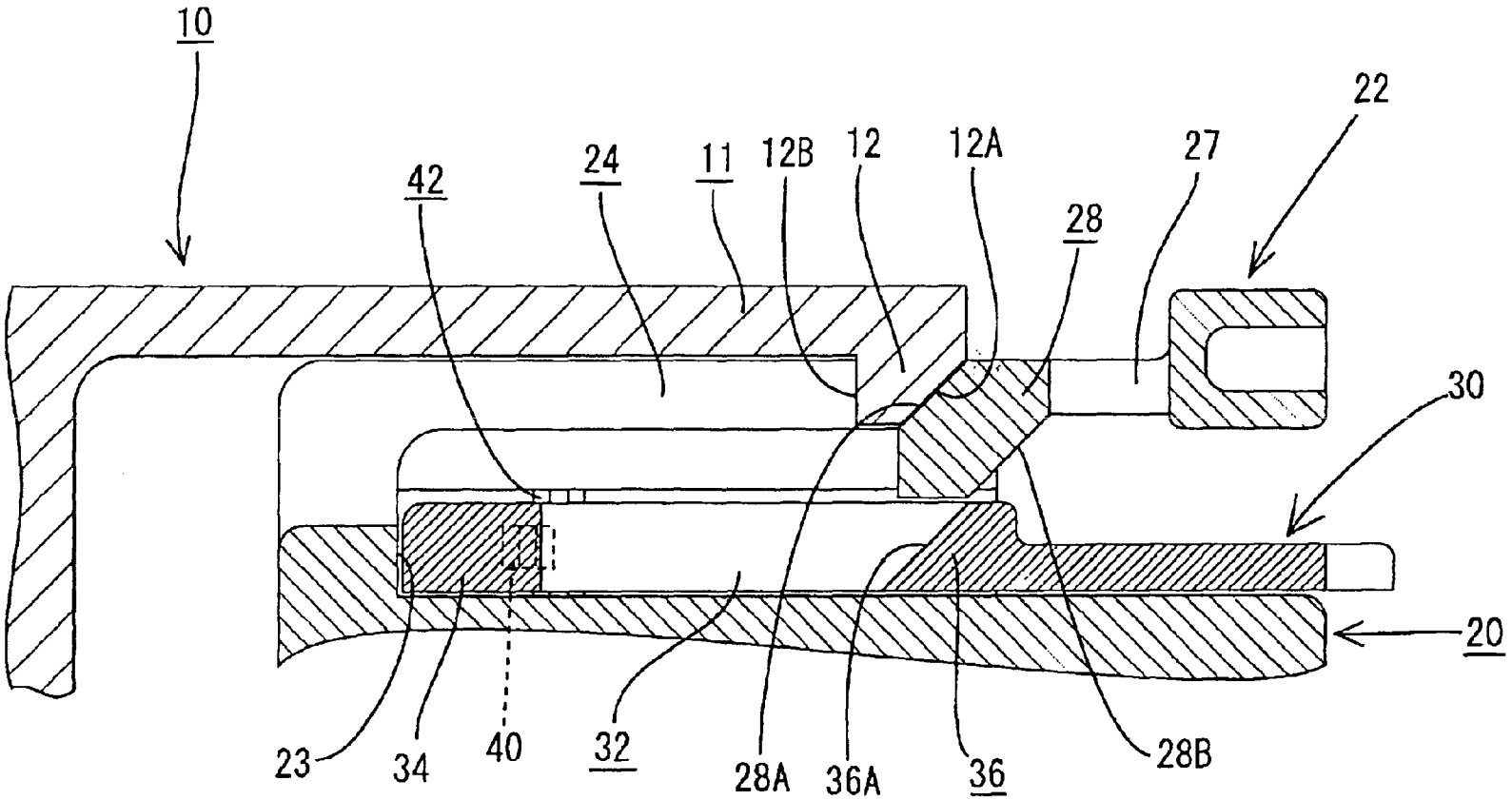
FIG. 3 is a sectional view taken along a line III—III of FIG. 2.

In the initial state before the first connector housing 10 and the second connector housing 20 are fit on each other, as shown in FIGS. 2 through 4, the fit-on detection member 30 is mounted on the second connector housing 20 at its initial position.

Figure 5:
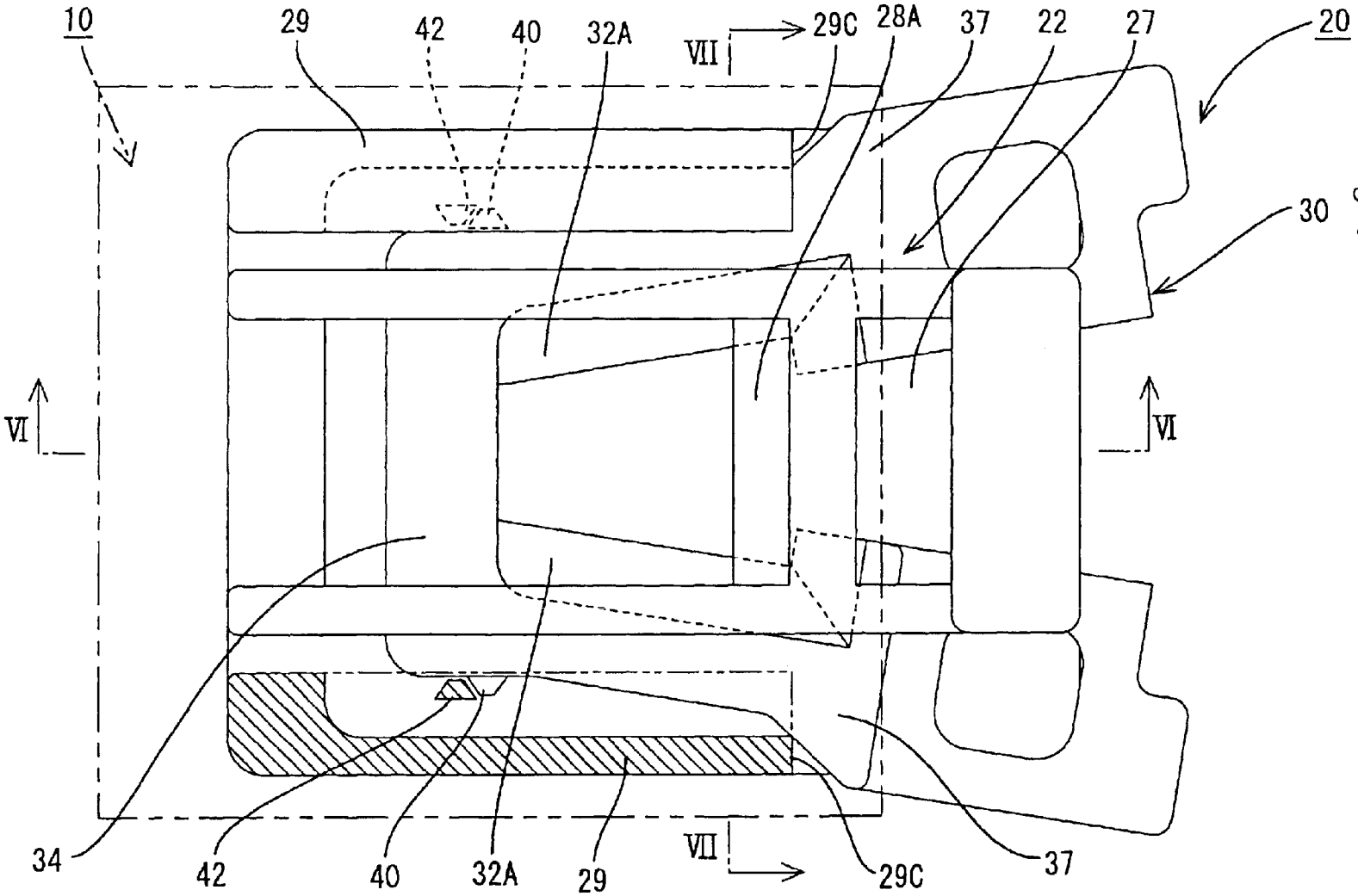
FIG. 5 is a partial cutaway plan view showing the state of the fit-on between first and second connector housings while an operation of fitting both connector housings on each other is being performed.
Figure 6:
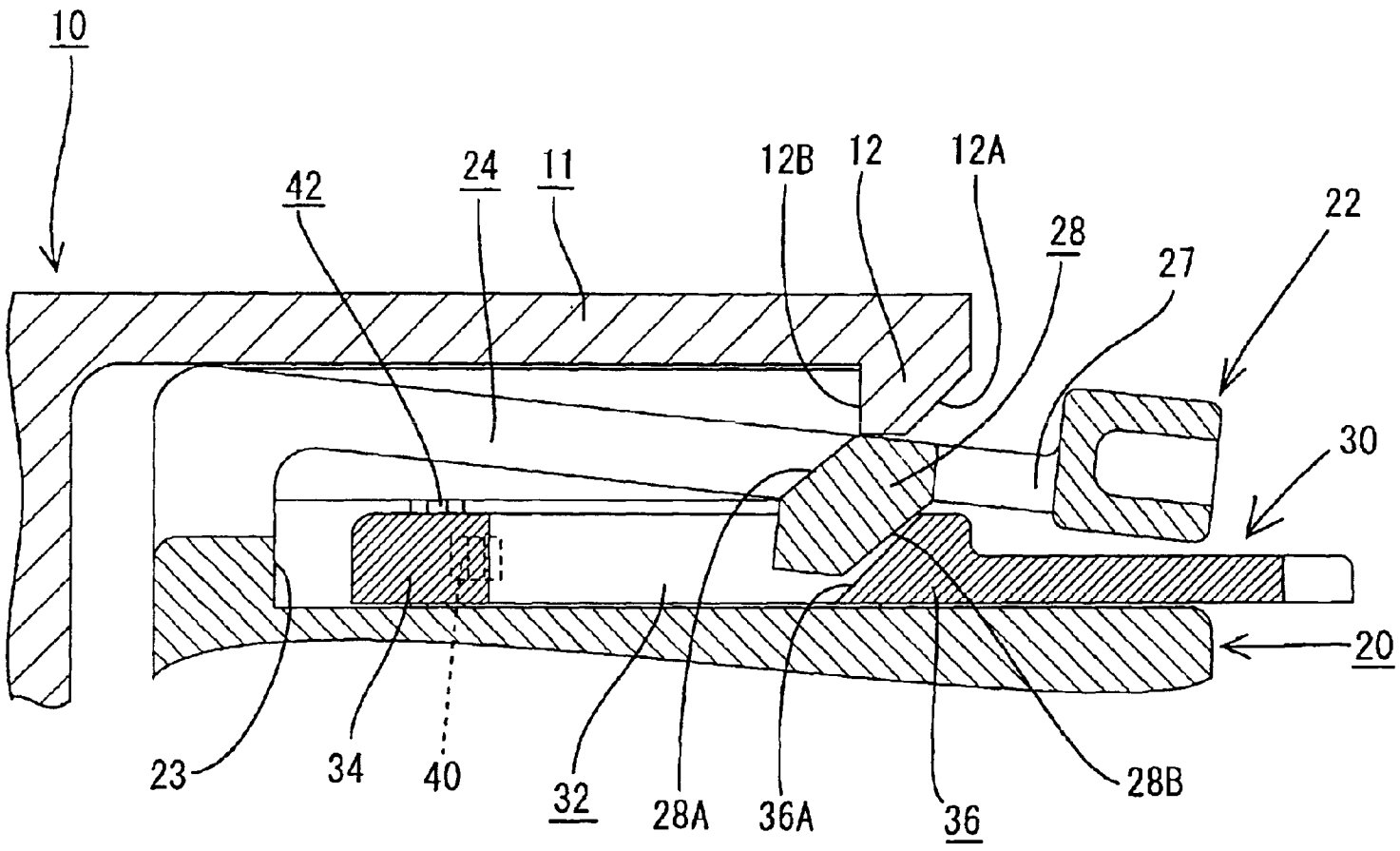
FIG. 6 is a sectional view taken along a line VI—VI of FIG. 5.
Figure 7:
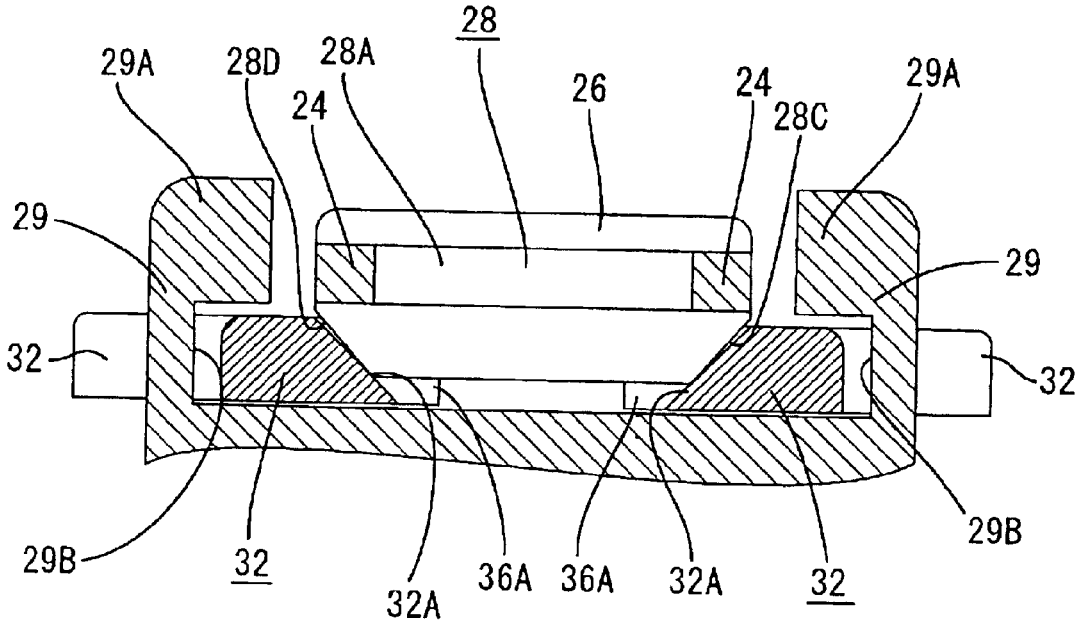
FIG. 7 is a sectional view taken along a line VII—VII of FIG. 5.

In this state, the second connector housing 20 is fitted on the hood part 11 of the first connector housing 10. While the operation of fitting the first connector housing 10 and the second connector housing 20 on each other is being performed, as shown in FIGS. 5 through 7, the locking projection 12 contacts and interferes with the locking piece 28. Consequently the locking arm 22 elastically deforms downward. At this time, the tapered surface 28B, disposed at the lower part of the rear surface of the connection locking piece 28, slides in contact with the inclined surface 36A of the inward projected part 36, and the fit-on detection member 30 moves rearward relatively to the locking arm 22. At this time, the connection locking piece 28 slides in contact with the inclined surface 32A of t elastic arm 32, and the elastic arm 32 elastically deforms outwardly. At this time, the locking projection 40 is unlocked from the rearward movement prevention projection 42. Thereby the fit-on detection member 30 is allowed to move rearward.

While the operation of fitting the first connector housing 10 and the second connector housing 20 on each other is being performed, the connection locking piece 28 is disposed between the elastic arms 32. Thus, the elastic arm 32 is prevented from elastically deforming inward or returning to its original state. Consequently the interference between the protection wall 29 and the outward projecting part 37 is maintained, and the connection locking piece 28 interferes with the inclined surface 36A. The interference securely prevents the forward pressing operation of the fit-on detection member 30 from being performed.

Figure 8:
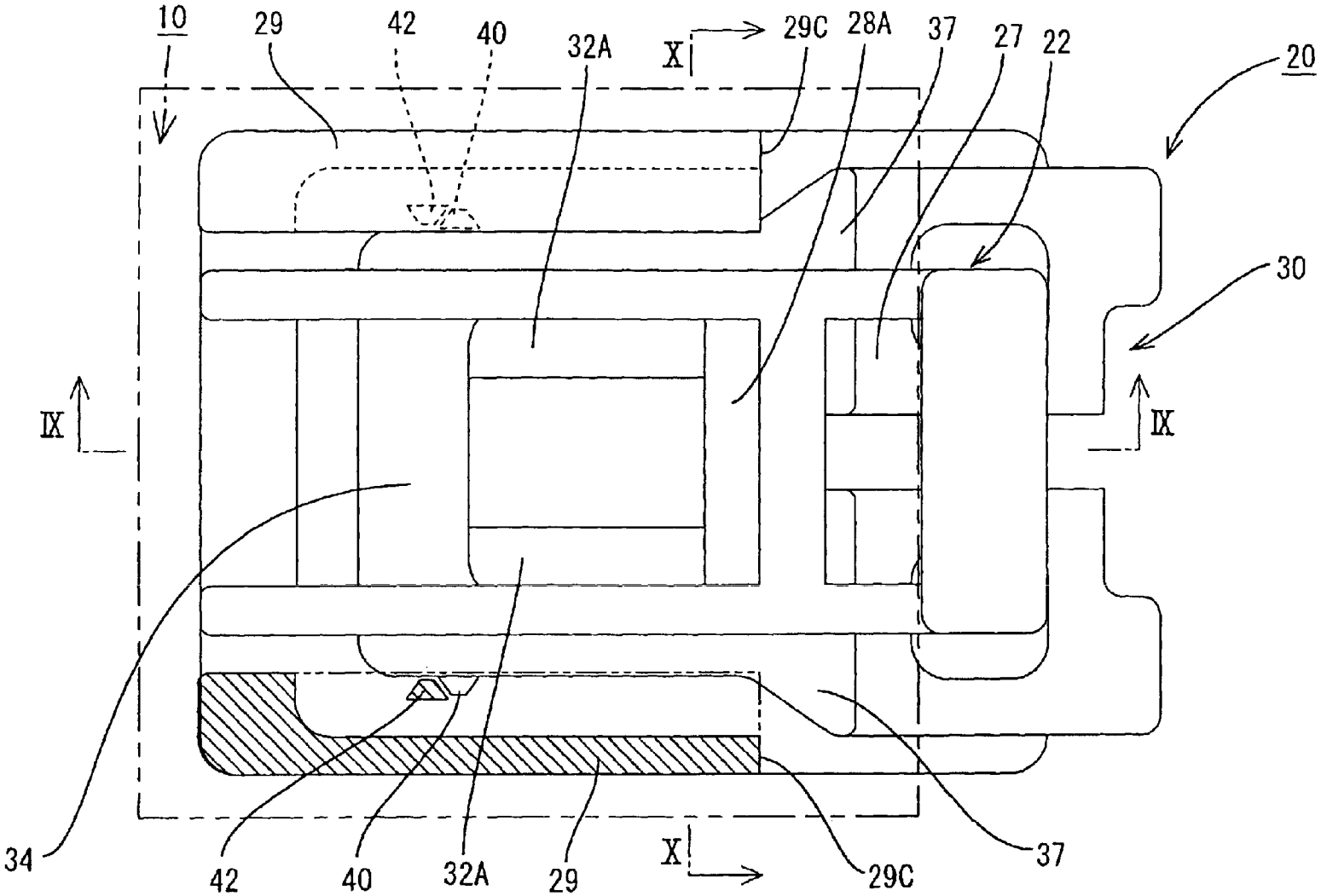
FIG. 8 is a partial cutaway plan view showing the state of the fit-on between first and second connector housings while an operation of fitting both connector housings on each other is being performed.

When the first connector housing 10 and the second connector housing 20 are placed in the normal fit-on state, as shown in FIGS. 8 and 9, the locking projection 12 rides across the connection locking piece 28 and does not interfere With it. Thus, the locking arm 22 returns to its original state due to its elastic deformation. Consequently the locking arm 22 and the first connector housing 10 are locked to each other. Accordingly, the first connector housing 10 and the second connector housing 20 are held in the normal fit-on state.

Figure 10:
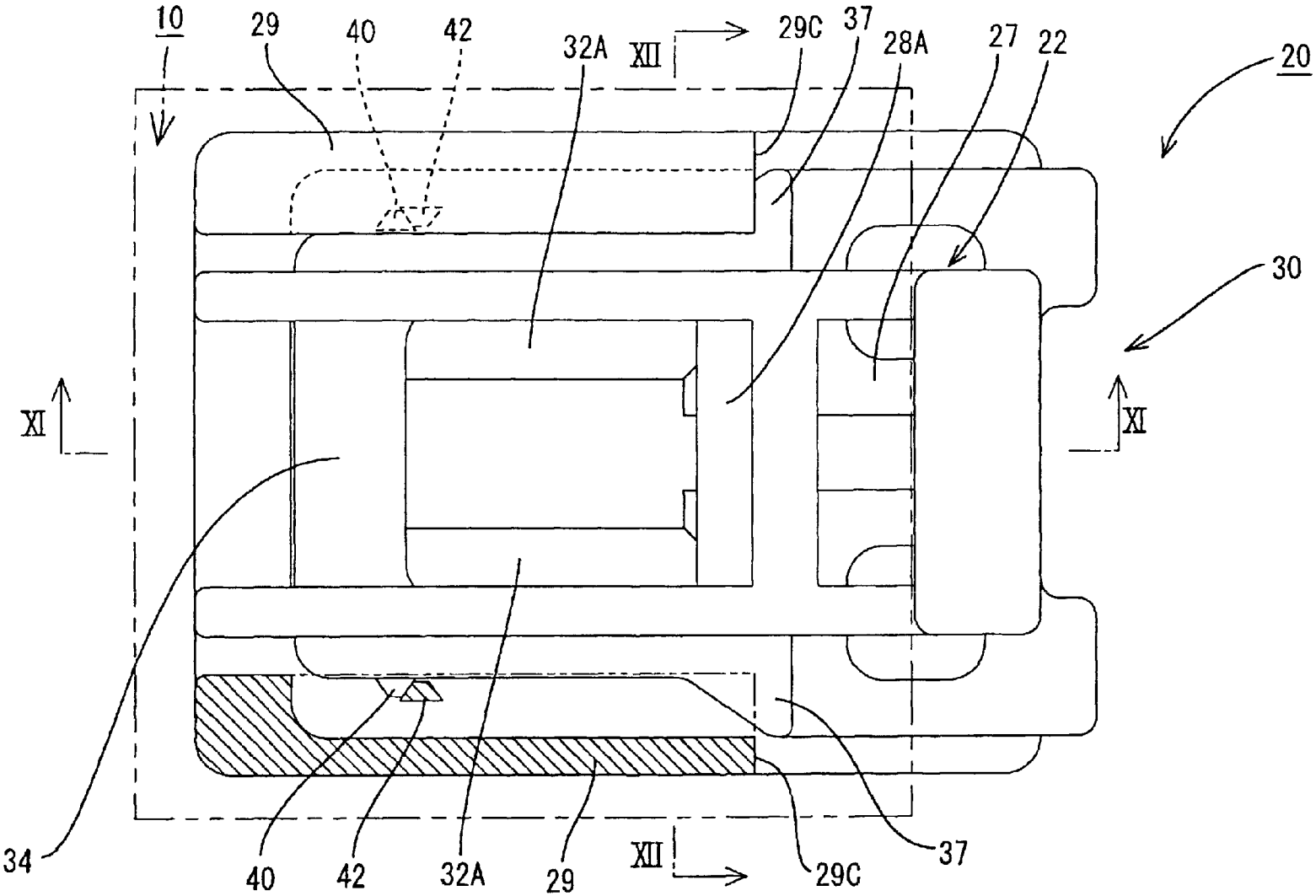
FIG. 10 is a partial cutaway plan view showing the normal state of the fit-on between first and second connector housings.
Figure 11:
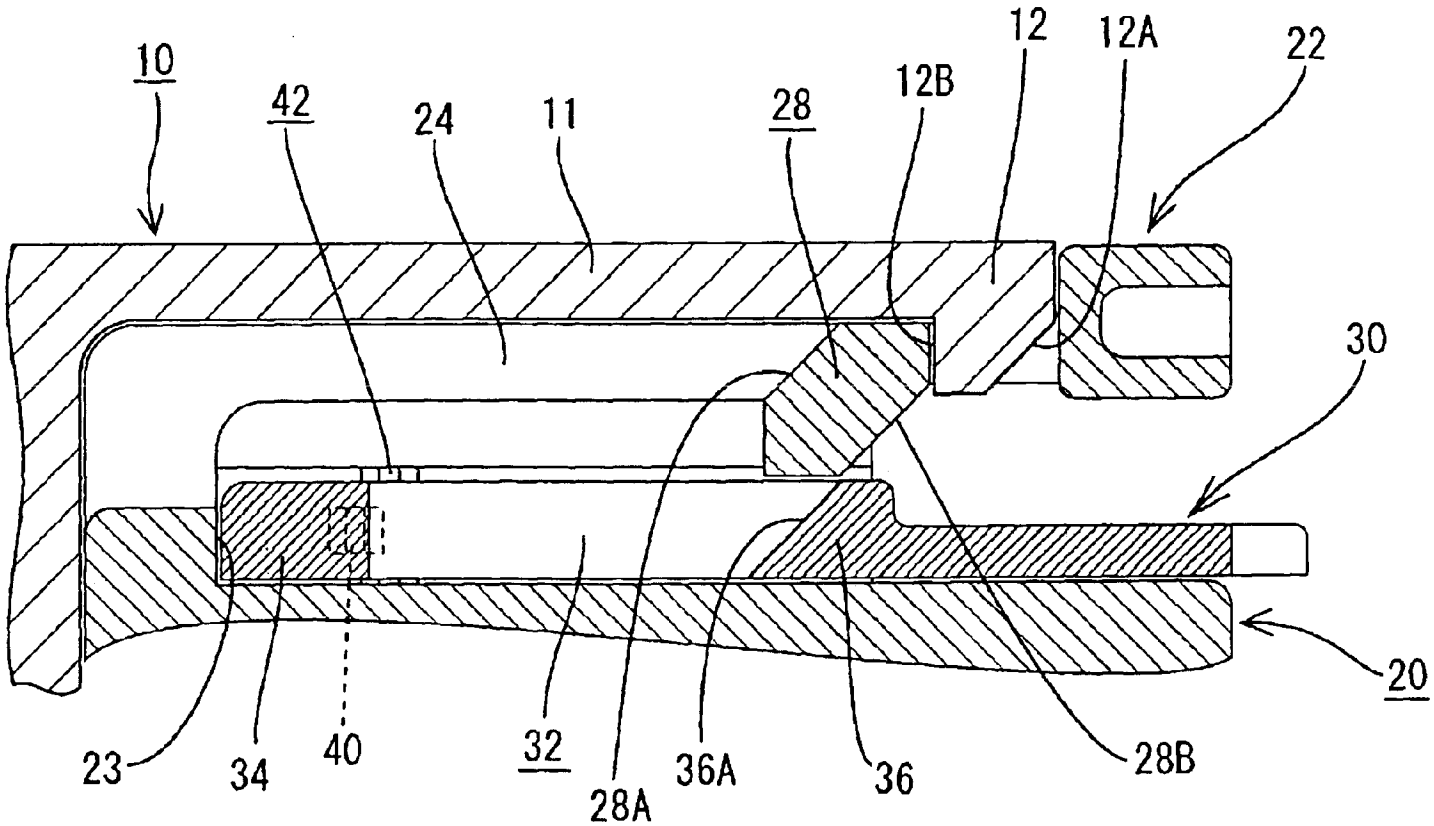
FIG. 11 is a sectional view taken along a line XI—XI of FIG. 10.

In this state, the connection locking piece 28 is disposes away from the in lined surfaces 32A and 36A, and there is no interference between the protection wall 29 an the outward projected part 37 and between the connection locking piece 28 and the inclined surface 36A. In this state, as shown in FIGS. 10 and 11, an operator can perform the forward pressing operation of the fit-on detection member 30. Thus, the operator can securely detect that the first connector housing 10 and the second connector housing 20 are in the normal fit-on state. When the fit-on detection member 30 has reached a detection position, the locking projection 40 again engages the rearward movement prevention projection 42.

To remove the first connector housing 10 and the second connector housing 20 from each other, the locking arm operation part 26 is elastically deformed to unlock the locking projected portion 12 from the window part 27 of the locking arm 22. Thereafter the first connector housing 10 and the second connector housing 20 are pulled apart from each other.

As described above, in the above-described embodiment, when the fit-on detection member 30 can be shifted to the detection position in the operation of fitting the first connector housing 10 and the second connector housing 20 on each other, the operator finds that the first connector housing 10 and the second connector housing 20 have fitted on each other in the normal state. On the other hand, when the fit-on detect on member 30 cannot be shifted to the detection position because of the interference between the fit-on detection member 30 and the protection wall 29 in the operation of fitting the first connector housing 10 and the second connector housing 20 on each other, the operator finds that the first connector housing 10 and the second connector housing 20 are fitted on each other in an abnormal state.

According to the connector having this construction, the addition of the fit-on detection mechanism does not necessitate an altered construction of the first connector housing 10.

Since the fit-on detection member 30 is disposed within the height of the flexing space 25, it is unnecessary to form a space for disposing the fit-on detection member 30. Therefore it is possible to reduce the height of the connector.

The fit-on detection member 30 has elastic arms 32 which are forcibly deformed, while the fitting operation of the first connector housing 10 to the second connector housing 20, on each other, is being performed. Therefore while the operation of fitting the first connector housing 10 and the second connector housing 20 on each other is being performed, the fit-on detection member 30 has a shape different from the shape at the time when the first connector housing 10 and the second connector housing 20 are fitted on each other in the normal state. Accordingly the operator can easily discriminate an abnormal fit-on state from the normal fit-on state.

In the connector of the embodiment, when the elastic arm 32 elastically deforms outward because the fit-on operation is being performed, the rear end 29C of the protecting wall 29 locks the outer surface 37A (stopping surface) disposed in the vicinity of the outward projected part 37. Therefore the protection wall 29, which is an ordinary construction of the second connector housing 20, can be effectively utilized to detect whether or not the first connector housing 10 and the second connector housing 20 have been normally fitted with each other.

In the connector of the embodiment, at the initial position, the fit-on detection member 30 is held at a position proximate to the base portion 23 of the locking arm 22. In the connector of the embodiment, when the locking arm 22 flexes during the operation of fitting the first connector housing 10 and the second connector housing 20 on each other, the fit-on detection member 30 moves rearward. That is, at the initial position, the fit-on detection member 30 is accommodated compactly in the flexing space 25 but the moving stroke of the fit-on detection member 30 is long while the operation of fitting the first connector housing 10 and the second connector housing 20 on each other is being performed. Therefore it is possible to prevent the connector from becoming large in the front-to-back direction. Further, in the connector of the embodiment, the elastic arm 32 is capable of elastically deforming outward in a widthwise direction of the fit-on detection member 30, thus contributing to the decrease in the height of the connector.

The present invention is not limited to the embodiment described above with reference to the drawings. For example, the following embodiments are included in the technical scope of the present invention. Further, various modifications of the embodiments can be made without departing from the spirit and scope of the present invention.

(1) In the above-described embodiment, the locking projection 12 (locking arm contact portion) flexes the locking arm 22. Instead, any construction that flexes the locking arm 22 can be used as the locking arm contact portion. For example, the edge of the open portion of the first connector housing 10 can be used to flex the locking arm 22.

(2) In the above-described embodiment, the fit-on detection member 30 deforms elastically outward in a horizontal direction. Instead it is possible to deform the fit-on detection member 30 outward elastically in a vertical direction.

(3) In the above-described embodiment, while the operation of fitting the first connector housing and the second connector housing on each other is being performed, the fit-on detection member 30 moves rearward relatively to the locking arm 22. Instead of this construction, at the initial state, the fit-on detection member 30 may be situated at a waiting position rearward from the detection position by a predetermined length.

(4) In the above-described embodiment, the fit-on detection member 30 elastically deformed is locked to the protection wall 29. However the protection all 29 is not an indispensable portion. Thus the fit-on detection member 30 may be locked to a portion of the second connector housing 20.

(5) In the above-described embodiment, the locking am 22 is cantilevered. However, the locking arm 22 may be supported at two points.

(6) In the above-described embodiment, the locking arm 22 has the two arm parts 24. Instead the locking arm 22 may have one arm part 24.

From the above description of the invention, those skilled in the art will perceive improvements, changes and modifications. Such improvements, changes and modifications within the skill of the art are intended to be covered by the appended claims.

What is claimed is:

1. A connector comprising a pair of connector housings capable of coupling with each other, one of said connector housings comprising:

a locking arm elastically deformable toward a flexing space by contacting with a locking arm contact portion formed on the other of said connector housings during coupling of said connector housings with each other, said locking arm returning to an original state when aid connector housings have been normally fitted with each other and are locked to one another, thereby holding said connector housings in a locked state;

a fit-on detection member disposed within a height of said flexing space, said fit-on detection member detecting whether said connector housings are in a normal fit-on state by determining whether said fit-on detection member can be pressed into said flexing space, said fit-on detection member is approximately U-shaped, with elastic arms being connected to a front portion of said one connector housing in a fit-on direction;

a first guide surface, formed on an opposed surface of each of said elastic arms, said first guide surface inclined in a widthwise direction of said fit-on detection member, said first guide surface slides in contact with said locking arm for guiding said elastic arms, which deform elastically outward, in said widthwise direction, of said fit-on detection member, when said locking arm elastically deforms;

a stopping surface formed on an outer surface of each of said elastic arms, said stopping surface being locked to a rear end of a protection wall erected at both sides of said locking arm of said one connector housing in a widthwise direction and said stopping surface extending in a front-to-back direction when said elastic arms elastically deform and a receiving portion formed on at least one of said elastic arms and locked to a locking portion formed on said one connector housing when said elastic arm is elastically deformed, whereby said fit-on detection member is prevented from pressing into said flexing space;

whereby when said connector housings are in said normal fit-on state, said elastic arms of said fit-on detection member returns to an original state by elastic deformation which occurs in association with a restoring operation of said locking arm to its original state, and said receiving portion is unlocked from said locking portion, whereby said fit-on detection member can be pressed into said flexing space.

2. A connector according to claim 1, wherein said locking arm is cantilevered and extends rearward, with a front end serving as a base;

said fit-on detection member is held at a position proximate to said base of said locking arm; and each of said elastic arms has a second guide surface inclining in a front-to-back direction of said fit-on detection member and in sliding contact said locking arm when said locking arm elastically deforms thereby moving said fit-on detection member rearward in combination with said elastic deformation of each of said elastic arms.

3. A connector according to claim 1, wherein said elastic arms are elastically deformable outward in a widthwise direction of said fit-on detection member.

* * * * *

UNITED STATES PATENT AND TRADEMARK OFFICE

CERTIFICATE OF CORRECTION

PATENT NO. : 6,824,421 B2
DATED : November 30, 2004
INVENTOR(S) : Hiroyuki Oka

It is certified that error appears in the above-identified patent and that said Letters Patent is hereby corrected as shown below:

Column 1,
Line 19, “fit-n” should be -- fit-on --
Line 31, “Position” should be -- position --
Line 46, “fit on” should be -- fit-on --

Column 4,
Line 54, “2” should be -- 12 --
Line 60, after “to”, insert -- an --

Column 5,
Lines 12 and 17, “part” should be -- parts --
Line 21, “peace” should be -- piece --
Line 40, “With” should be -- with --
Line 57, “fit-o” should be -- fit-on --

Column 6,
Line 23, “engage” should be -- engages --
Line 55, “th” should be -- the --

Column 7,
Line 4, after “elastic”, insert -- arm --
Line 64, after “the”, insert -- connection --

Column 8,
Line 5, “t” should be -- the --
Line 24, “With” should be -- with --
Line 30, “disposes” should be -- disposed --
Line 56, “detect on” should be -- detection --

Column 9,
Line 19, “protecting” should be -- protection --

UNITED STATES PATENT AND TRADEMARK OFFICE

CERTIFICATE OF CORRECTION

PATENT NO. : 6,824,421 B2
DATED : November 30, 2004
INVENTOR(S) : Hiroyuki Oka

It is certified that error appears in the above-identified patent and that said Letters Patent is hereby corrected as shown below:

Column 10,
Line 9, “am” should be -- arm --
Line 29, “aid” should be -- said --

Signed and Sealed this

Tenth Day of May, 2005

JON W. DUDAS
*Director of the United States Patent and Trademark Office*